United States Patent [19]

Hill et al.

[11] Patent Number: 4,659,489

[45] Date of Patent: Apr. 21, 1987

[54] LUBRICANT DISPERSIONS FOR PAPER COATING COMPOSITIONS

[75] Inventors: John A. Hill, Somerville; Gregory J. Flynn, Branchville, both of N.J.

[73] Assignee: Diamond Shamrock Chemicals Company, Dallas, Tex.

[21] Appl. No.: 623,471

[22] Filed: Jun. 22, 1984

[51] Int. Cl.[4] ..... C10M 105/08

[52] U.S. Cl. ..... 252/40.5; 252/52 A; 428/537.5

[58] Field of Search ..... 428/537.5; 427/153; 162/179; 252/40.5, 52 A

[56] References Cited

U.S. PATENT DOCUMENTS 2,425,828 8/1947 Retzsch et al. .

FOREIGN PATENT DOCUMENTS 7327943 3/1974 France .

OTHER PUBLICATIONS

Kearns et al, Paper Trade Journal, Jul. 24, 1967, pp. 40–41.

Kelly, Jr. et al, Tappi, vol. 53, No. 10 (Oct. 1970), pp. 1900–1904.

Encyclopedia of Chemical Technology—Kirk-Othmer, 2nd Ed. (1967), vol. 14, pp. 515–520.

Pulp and Paper—Chemistry & Chemical Technology—Casey, 2nd Ed. (1961), vol. III, pp. 1552, 1579–1581; 1592–1594; 1597; 1646–1647; 1650.

Paper Coating Additives—Tappi Monograph Series No. 25 (1963) pp. 84–85.

*Primary Examiner*—Edith Buffalow

*Attorney, Agent, or Firm*—Neal T. Levin

[57] ABSTRACT

Aqueous lubricant dispersions having solids content of from about 50% by weight to about 75% by weight contain calcium stearate, dispersing agent, nonionic lubricant and urea are characterized by increased solids content.

7 Claims, No Drawings

LUBRICANT DISPERSIONS FOR PAPER COATING COMPOSITIONS

BACKGROUND OF THE INVENTION

1. Field of the Invention

This invention relates to increased solids lubricant dispersions which are the source of calcium stearate, a lubricant present as a component of paper and paperboard coating compositions.

2. Description of the Prior Art

Calcium stearate, a water insoluble metal soap, is a recognized component of paper coating compositions. It contributes lubricating, leveling and anti-dusting properties to paper coating compositions which contain primarily pigment, adhesive and lubricant in an aqueous system.

Where the lubricant is calcium stearate, a water insoluble soap, it is generally supplied as an aqueous dispersion which can be introduced along with the other components in the preparation of the paper coating. Such dispersion contains at most 50 to 55% by weight solids including calcium stearate and dispersing agent. Attempts to increase calcium stearate content result in formation of a paste. Further, when the calcium stearate dispersion is prepared by the in situ method, at most, 55% by weight solids is obtained.

U.S. Pat. No. 2,425,828—Retzsch et al, Aug. 19, 1947, discloses preparation of dispersions of metal soaps including calcium stearate using polyethylene glycol mono-esters of fatty acids as dispersing agents. In the examples, dispersions of 40% calcium stearate, 10% dispersing agent and 50% water (50% total solids) are disclosed.

French publication No. 73-27943, published Mar. 1, 1974, discloses lubricants for starch base paper coatings which contain a first lubricant such as calcium stearate and a second lubricant such as modified tallow, preferably de-acidified tallow, neutralized tallow and hydrogenated tallow. Less preferred are tallow substituted with lower alkyl groups, particular waxes, polyethylene glycols and saturated fatty alcohols. Moderately preferred are fatty acid esters. Somewhat lesser preferred are polyethylene glycol esters of fatty acids; however, no examples are provided.

Kearns et al, Paper Trade Journal, July 24, 1967 (p. 40 et seq), in Table I refer to a 53% minimum calcium stearate dispersion.

Kelly, Jr. et al in Tappi Vol. 53, No. 10, page 1900 et seq, describe studies of the factors affecting performance of aqueous solutions of polyethylene glycols and their derivatives as lubricants when present in coating formulations.

The art, however, has not developed calcium stearate dispersions of greater solids content. The advantages of such are reduced shipping costs since less water is shipped. Further, when added to the coating composition, less water is introduced meaning less energy is required to remove same during the drying operation.

SUMMARY OF THE INVENTION

Aqueous lubricant dispersions for addition to paper and paperboard coating compositions having a solids content of from about 50% by weight to about 75% by weight, preferably from about 55% by weight to about 75% by weight have been prepared.

The solids content of these dispersions comprises (1) calcium stearate, (2) dispersing agent, (3) nonionic lubricant and (4) urea.

Thus, lubricant compositions containing greater total solids content have been developed. These compositions, despite reduced calcium stearate content, are as effective as lubricants as the present calcium stearate dispersions containing less total solids content but greater calcium stearate content.

It was most unexpected to find that the combination of nonionic lubricant and relatively large amounts of urea together with calcium stearate forms a high solids content product which functions equally to or better than calcium stearate lubricants and which has a workable viscosity. While not bound by any theory, it is believed that the foregoing is achieved by at least a portion of the urea forming inclusion compounds with the nonionic lubricant.

DESCRIPTION OF THE PREFERRED EMBODIMENTS

Lubricant Dispersion

The lubricant dispersions contain from about 50% by weight to about 75% by weight, preferably from about 55% by weight to about 75% by weight solids, the remaining component being water. The solids content of the dispersion comprises:

| Component | Parts by Weight |
|---|---|
| calcium stearate | 1.00 |
| dispersing agent for calcium stearate | about 0.01 to about 0.10 |
| nonionic lubricant | about 0.05 to about 5.00 |
| urea | about 0.01 to about 1.00 |

Generally speaking, useful viscosities of these lubricant dispersions can range up to about 1,500 cps Brookfield at 60 rpm.

Calcium stearate is a well known article of commerce and its use in dispersions is well known. Any calcium stearate useful in paper coating compositions is useful herein. Depending upon the grade of stearic acid used in its preparation, there will be present other fatty material such as palmitic and oleic acid. Thus, the term calcium stearate covers calcium stearate as well as calcium stearate containing varying amounts of calcium palmitate, calcium oleate and other materials.

The dispersing agents can be those which are known to disperse calcium stearate in water. Useful dispersing agents are those described in U.S. Pat. No. 2,425,828 such as polyethylene glycol monoesters of fatty acids. Generally, the polyethylene glycol should have a molecular weight of 200 or above such as polyethylene glycols having molecular weights of 200, 300 and 400.

The fatty acids which may be esterified by these glycols may be any fatty acid having from 10 to 24 carbon atoms, such as lauric acid, oleic acid and stearic acid, as well as mixtures of acids obtained from natural glycerides such as mustard seed oil, coconut oil and other naturally occurring oils as well as the glycerides themselves.

Specific examples of dispersing agent are the monoesters of the reaction product of polyethylene glycol 400 and mustard seed oil as described in Example I of U.S. Pat. No. 2,425,828 and the reaction product of polyethylene glycol 400 and coconut fatty acids as described in Example II of U.S. Pat. No. 2,425,828.

Other useful dispersing agents include polyoxyethylene adducts of alkylated phenols. Generally, the alkyl group contains from 8 to 16 carbon atoms such as in octyl phenol, nonyl phenol and dodecyl phenol and can be straight or branched chain. The alkylated phenol can be reacted with from about 6 to about 15 moles of ethylene oxide. Examples include octyl phenol reacted with 9 moles of ethylene oxide and dodecyl phenol reacted with 12 moles of ethylene oxide. Also, ethoxylated alcohols such as the adduct of tridecyl alcohol and six moles of ethylene oxide can be used.

The lubricants can be one or a mixture of particular nonionic lubricants. Examples of nonionic lubricants are one or more nonionic materials having a molecular weight range of from about 230 to about 10,000.

Useful nonionic lubricants include polyalkylene glycol mono and di esters of fatty acids such as ethylene oxide and propylene oxide adducts of fatty acids; ethylene oxide adducts of fatty amides; ethylene oxide adducts of fatty alcohols; lower alkyl mono ethers of ethylene oxide-propylene oxide random or block copolymers such as $C_1$–$C_8$ alkyl mono ethers; sorbitan esters of fatty acids; ethylene oxide and propylene oxide adducts of sorbitan esters of fatty acids; lower alkyl mono ethers of polyethylene glycol mono esters of fatty acids such as $C_1$–$C_8$ alkyl mono ethers, and ethylene oxide-propylene oxide random or block copolymers.

The fatty acids which may be esterified to form the nonionic lubricant or which may be the base for polyalkoxylation to form the nonionic lubricant may be one or more saturated or unsaturated fatty acid or dimer acid having from 8 to 36 carbon atoms such as lauric acid, oleic acid and stearic acid as well as mixtures of acids obtained from natural glycerides such as mustard seed oil, coconut oil, castor oil or tall oil as well as the glycerides themselves.

Fatty amides which may be used for reaction with ethylene oxide are stearamide, oleylamide and mixtures such as cocoamide and tallow amide.

Saturated and unsaturated fatty alcohols having from 8 to 24 carbon atoms such as stearyl alcohol and oleyl alcohol as well as glycerols containing these alcohols may also be used for reaction with ethylene oxide and propylene oxide.

Examples of nonionic lubricants are: the reaction products of coconut fatty acids plus five moles of ethylene oxide; the reaction products of polyethylene glycol 1000 and dioleic acid; polyethylene glycol 4000 stearate (monoester); polyethylene glycol 400 laurate (monoester); polyethylene glycol 600 dioleate; polyethylene glycol 400 cocoate (predominately monoester); oleyl amide condensed with 5 moles of ethylene oxide; stearyl alcohol condensed with 8 moles of ethylene oxide; 20 moles of ethylene oxide reacted with cetyl alcohol; sorbitan monolaurate; sorbitan monostearate; the reaction product of sorbitan and coconut fatty acids in a 1:1 mole ratio and the reaction product of ethoxylated methanol (mol. wt=385) and coconut fatty acids. Further examples include ethylene oxide-propylene oxide (1:1 mole ratio) random copolymer adduct of butyl alcohol reacted to a molecular weight of 4,200; polyethylene glycol 950 reacted with propylene oxide to a molecular weight of 1100; polyoxyethylene (4) sorbitan monolaurate and polyoxyethylene (20) sorbitan monostearate.

The preparation of these dispersions can be carried out in the following manner. Dry calcium stearate is dispersed in water with a dispersing agent. Generally from about 0.01 to about 0.10 parts by weight of dispersing agent per 1.00 part by weight calcium stearate is used. Therefore, nonionic lubricant and urea are added to the dispersion in any order or together.

At this point, it can be seen that the starting point of this invention can be, if desired, the conventional calcium stearate dispersions of no more than 55% by weight of solids. They are prepared by reacting stearic acid or fatty acid mixture containing stearic acid with a calcium containing material such as calcium hydroxide in the presence of water and dispersant using thorough mixing. The preparation of these dispersions is well known and the use of same herein is not limited to any particular calcium stearate, or any particular dispersing agent.

To the lubricant dispersion, regardless of its source, there is added from about 0.05 part by weight to about 5.00 parts by weight of lubricant per 1.00 part by weight of calcium stearate and urea in amounts of from about 0.01 to about 1.00 part by weight per 1.00 part by weight of calcium stearate in any order or together.

Where the nonionic lubricant is of the same chemical nature as the dispersing agent, the proportions of each may overlap. In such instances, it is only necessary that the total amount of such chemical which is present satisfy the requirements for both functions.

Coating Composition

The coating compositions to which the high solids lubricant dispersions are added are well known and the addition of the high solids lubricant dispersion is not limited to any particular coating composition.

The coating compositions contain in addition to a lubricant both pigment and binder (adhesive), and optionally, solubilizer, all in an aqueous system. Typical pigments are clay (Kaolin), calcium carbonate, satin white, talc, titanium dioxide, zinc oxide and blanc fixe, while typical binders are starch, such as ethylated and oxidized starch, protein such as soya protein and casein, and synthetic resins such as butadiene styrene latex such as a 60/40 styrene/butadiene copolymer and polyvinyl acetate-acrylic copolymer.

Examples of insolubilizer are melamine-formaldehyde resin and glyoxal-urea reaction product.

The starch is generally cooked in water, then added to a dispersion of the pigment. Thereafter, the high solids calcium stearate lubricant is introduced. Based on 100 parts by weight pigment, there is used from about 10 to about 25 parts by weight binder and from about 0.5 to about 1.5 parts by weight of lubricant solids. Optionally, there can be used from about 0.4 to about 2.5 parts by weight of insolubilizer.

The solids content of the coating composition can vary from about 30% by weight to about 70% by weight, the remainder being water.

The coating compositions containing the high solids lubricant are applied to paper and paperboard by conventional methods which include the steps of applying the coating compositions to the paper or the paperboard, smoothing, drying and calendering or supercalendaring.

For a fuller understanding of this invention, reference may be made to the following examples. These examples are given merely to illustrate the invention and are not to be construed in a limiting sense.

Examples I through XV describe the increased solids lubricant dispersions of this invention. All were prepared according to the following general procedure.

A 50% by weight calcium stearate dispersion was placed in a laboratory mixer. Additional water as required was added, followed by addition of urea and nonionic lubricant. Mixing was carried out until a homogeneous dispersion was formed. Viscosities were determined for the compositions of each example using a Brookfield Viscometer at 60 rpm.

| Component | Parts by Weight |
|---|---|
| **EXAMPLE I** | |
| calcium stearate | 26.14 |
| condensate of nonyl phenol + 10 moles ethylene oxide | 1.60 |
| polyoxyethylene (20) sorbitan monolaurate | 18.63 |
| urea | 18.63 |
| water | 35.00 |
| viscosity = 320 cps | |
| **EXAMPLE II** | |
| calcium stearate | 26.14 |
| condensate of nonyl phenol + 10 moles ethylene oxide | 1.60 |
| polyethylene glycol 400 cocoate[1] | 18.63 |
| urea | 18.63 |
| water | 35.00 |
| viscosity = 500 cps | |
| **EXAMPLE III** | |
| calcium stearate | 26.14 |
| condensate of nonyl phenol + 10 moles ethylene oxide | 1.60 |
| polyethylene glycol 950 + 3 moles of propylene oxide | 18.63 |
| urea | 18.63 |
| water | 35.00 |
| viscosity = 250 cps | |
| **EXAMPLE IV** | |
| calcium stearate | 26.14 |
| condensate of nonyl phenol + 10 moles ethylene oxide | 1.60 |
| tallow amide condensed with 13 moles of ethylene oxide | 18.63 |
| urea | 18.63 |
| water | 35.00 |
| viscosity = 1,500 cps | |
| **EXAMPLE V** | |
| calcium stearate | 26.14 |
| condensate of nonyl phenol + 10 moles ethylene oxide | 1.60 |
| mono butyl ether of random copolymer of equimolar amounts of ethylene oxide and propylene oxide (mol. wt. = 4200) | 18.63 |
| urea | 18.63 |
| water | 35.00 |
| viscosity = 600 cps | |
| **EXAMPLE VI** | |
| calcium stearate | 26.14 |
| condensate of nonyl phenol + 10 moles ethylene oxide | 1.60 |
| ethoxylated methanol (mol. wt. = 385) esterified with coco fatty acids | 18.63 |
| urea | 18.63 |
| water | 35.00 |
| viscosity = 250 cps | |
| **EXAMPLE VII** | |
| calcium stearate | 26.14 |
| condensate of nonyl phenol + 10 moles ethylene oxide | 1.60 |
| polyethylene glycol 1,000 monolaurate | 18.63 |
| urea | 18.63 |
| water | 35.00 |
| viscosity = 400 cps | |
| **EXAMPLE VIII** | |

-continued

| Component | Parts by Weight |
|---|---|
| calcium stearate | 14.08 |
| condensate of nonyl phenol + 10 moles ethylene oxide | 0.92 |
| polyethylene glycol 400 cocoate[1] | 40.00 |
| urea | 10.00 |
| water | 35.00 |
| viscosity = 740 cps | |
| **EXAMPLE IX** | |
| calcium stearate | 32.86 |
| condensate of nonyl phenol + 10 moles ethylene oxide | 2.14 |
| polyethylene glycol 400 cocoate[1] | 5.00 |
| urea | 25.00 |
| water | 35.00 |
| viscosity = 120 cps | |
| **EXAMPLE X** (solids content, 75% by wt.) | |
| calcium stearate | 29.21 |
| condensate of nonyl phenol + 10 moles ethylene oxide | 1.79 |
| polyethylene glycol 600 monolaurate | 22.00 |
| urea | 22.00 |
| water | 25.00 |
| viscosity = 1,010 cps | |
| **EXAMPLE XI** (solids content, 70% by wt.) | |
| calcium stearate | 27.33 |
| condensate of nonyl phenol + 10 moles ethylene oxide | 1.67 |
| polyethylene glycol 600 monolaurate | 20.50 |
| urea | 20.50 |
| water | 30.00 |
| viscosity = 410 cps | |
| **EXAMPLE XII** (solids content, 60% by wt.) | |
| calcium stearate | 23.37 |
| condensate of nonyl phenol + 10 moles ethylene oxide | 1.43 |
| polyethylene glycol 600 monolaurate | 17.60 |
| urea | 17.60 |
| water | 40.00 |
| viscosity = 85 cps | |
| **EXAMPLE XIII** (solids content, 55% by wt.) | |
| calcium stearate | 21.48 |
| condensate of nonyl phenol + 10 moles ethylene oxide | 1.32 |
| mono butyl ether of random copolymer of equimolar amounts of ethylene oxide and propylene oxide (mol. wt. = 4200) | 16.10 |
| urea | 16.10 |
| water | 45.00 |
| viscosity = 55 cps | |
| **EXAMPLE XIV** (solids content, 50% by wt.) | |
| calcium stearate | 19.41 |
| condensate of nonyl phenol + 10 moles ethylene oxide | 1.19 |
| mono butyl ether of random copolymer of equimolar amounts of ethylene oxide and propylene oxide (mol. wt. = 4200) | 14.70 |
| urea | 14.70 |
| water | 50.00 |
| viscosity = 35 cps | |
| **EXAMPLE XV** (solids content, 65% by wt.) | |
| calcium stearate | 26.14 |
| condensates of nonyl phenol + 10 moles ethylene oxide | 1.60 |
| polyethylene glycol 200 dilaurate | 18.63 |
| urea | 18.63 |
| water | 35.00 |

-continued

| Component | Parts by Weight |
|---|---|
| viscosity = 1,400 cps | |

[1]Predominately monoester

Of the above examples, Examples I through IX and XV describe a 65% by weight solids lubricant while Examples X through XIV describe lubricants of solids content from 50% to 75% by weight solids. Since the inability to use calcium stearate dispersions of greater than 55% by weight solids is a result of the high viscosities obtained, it can be seen that these high solids lubricants have useful viscosities up to about 75% by weight solids. The result is a product which is flowable, pumpable and filterable; thus providing the same ease of handling as a 55% by weight calcium stearate dispersion.

Examples XVI through XX describe coating compositions which have been prepared in part using the increased solids lubricant dispersions of this invention. In these examples, all parts by weight of the components which are introduced with water are reported on a solids basis. Total water present in each example is of course reported.

Examples XVI and XVII were prepared according to the following general procedure.

Pre-slurried clay (70% by weight solids) and uncooked, oxidized starch and water were blended together under agitation at ambient temperature to 59% total solids. The resulting slurry was pumped first through an inline jet cooker where slurry temperature was instantaneously increased by direct steam to 210° F. and then to a jacketed cooling and holding vessel. Carboxylated styrene-butadiene (SB) latex (50% by weight solids) was immediately added followed by addition of the high solids lubricant composition of this invention and insolubilizer (45% by weight solids). The resulting coating was cooled to 110° F. to 120° F. prior to application.

| Component | Parts by Weight |
|---|---|
| EXAMPLE XVI | |
| clay (No. 2 coating clay) | 100.0 |
| starch (oxidized corn starch) | 16.0 |
| carboxylated SB latex (Dow 620) | 4.0 |
| Berset 47 (insolubilizer-Bercen, Inc.) | 0.5 |
| lubricant solids of Example II | 0.8 |
| total water | 99.3 |
| EXAMPLE XVII | |
| clay (No. 2 coating clay) | 100.0 |
| starch (oxidized corn starch) | 16.0 |
| carboxylated SB latex (Dow 620) | 4.0 |
| Berset 47 (insolubilizer-Bercen, Inc.) | 0.5 |
| lubricant solids of Example VII | 0.8 |
| total water | 99.3 |

Examples XVIII through XX were prepared according to the following procedure.

Pre-dispersed, spray dried clay was dispersed in water at 70% by weight total solids. Oxidized starch was slurried in tap water at ambient temperature in a jacketed vessel and cooked at 190° F. for 30 minutes. The cooked starch was then blended with the clay slurry under agitation supplied by a high speed laboratory stirrer. Then carboxylated styrene-butadiene (SB) latex (50% by weight solids) and the high solids lubricant composition of this invention were added and total coating solids adjusted with tap water to 50% by weight of total.

| Component | Parts by Weight |
|---|---|
| EXAMPLE XVIII | |
| clay (No. 2 coating clay) | 100.0 |
| starch (oxidized corn starch) | 8.0 |
| carboxylated SB latex (Dow 620) | 8.0 |
| lubricant solids of Example II | 1.0 |
| total water | 117.0 |
| EXAMPLE XIX | |
| clay (No. 2 coating clay) | 100.0 |
| starch (oxidized corn starch) | 8.0 |
| carboxylated SB latex (Dow 620) | 8.0 |
| lubricant solids of Example IV | 1.0 |
| total water | 117.0 |
| EXAMPLE XX | |
| clay (No. 2 coating clay) | 100.0 |
| starch (oxidized corn starch) | 8.0 |
| carboxylated SB latex (Dow 620) | 8.0 |
| lubricant solids of Example V | 1.0 |
| total water | 117.0 |

Coatings upon 50 pound web-offset paper using the coating compositions of Examples XVIII, XIX and XX were prepared by rod application using a Keegan coater. Coated sheets were supercalendered at 1,200 pounds per linear inch. Thereafter, gloss data, from which the effect of the high solids lubricant on gloss of the coated sheet is determined, were obtained according to TAPPI Method No. T 480 OS-78. An average of four readings appear below.

| Coating | Viscosity (Brookfield #4 at 100 RPM) | Gloss |
|---|---|---|
| control* | 700 cps | 52.8 |
| Example XVIII | 720 cps | 53.4 |
| Example XIX | 740 cps | 53.9 |
| Example XX | 640 cps | 56.3 |

*Calcium stearate solids substituted for the solids content of the lubricants of this invention.

From the foregoing, it is concluded that by substituting the high solids lubricants of this invention for the calcium stearate solids of a typical coating composition, there are no harmful effects on the viscosity of the coating composition and no harmful effects on the resulting gloss developed by the coating composition. In fact, some of the high solids lubricant compositions provide a lower coating viscosity, i.e., reduced soap response and higher gloss than does calcium stearate alone at equal solids level.

Additionally, coatings prepared from the coating compositions of Examples XVI and XVII were evaluated on a pilot coater to determine the effect of the high solids lubricant on various coating properties. Evaluation methods are described below.

| Test | Procedure |
|---|---|
| Gloss | TAPPI Method No. T 480 OS-78 |
| Ink gloss | Measure gloss before and after applying ink |
| Brightness | Use a GE optical brightness meter according to TAPPI Method No. T 452 OS-77 |
| Wax Pick resistance | TAPPI Method No. T 459 OS-75 |
| I.G.T. Pick | Use I.G.T. printability tester according to TAPPI Method No. |

-continued

| Test | Procedure |
|---|---|
| | T 499 SU-64 |

The data are set forth in Table I below.

-continued

| Component | Parts by Weight |
|---|---|
| a molecular weight between about 230 to about 10,000 | |
| urea | about 0.01 to about 1.00 |

TABLE I

| Coating | Viscosity Brookfield at 12 RPM (cps) | Finished Wt. (lbs/3300 sq. feet) | Gloss (Front/Back) | Ink Gloss (Front/Back) | Brightness (Front/Back) | Wax Pick Resistance (Front/Back) | I.G.T. Pick (Front/Back) |
|---|---|---|---|---|---|---|---|
| Control* | 5000 | 48.4 | 50/51 | 61/64 | 72/72 | 8/9 | 121/126 |
| Ex. XVI | 6100 | 47.8 | 52/53 | 63/64 | 71/72 | 9/9 | 131/131 |
| Ex. XVII | 6500 | 47.7 | 53/53 | 65/64 | 71/72 | 8/9 | 126/126 |

*Calcium stearate solids substituted for the solids content of the lubricant of this invention.

From the data of Table I, it is concluded that substituting the high solid lubricants for calcium stearate solids of a typical coating composition results in no harmful effects on the properties of the coated sheet. In fact, in some cases, e.g., gloss and I.G.T. Pick, the high solids lubricants of this invention provide improved performance over calcium stearate alone at equal solids level.

While the invention has been described with reference to certain specific embodiments thereof, it is understood that it is not to be so limited since alterations and changes may be made therein which are within the full intended scope of the appended claims.

What is claimed is:

1. High solids dispersions in water having from about 50% by weight to about 75% by weight solids and from about 25% by weight to about 50% by weight water, the solids content comprising:

| Component | Parts by Weight |
|---|---|
| calcium stearate | 1.00 |
| at least one calcium stearate dispersing agent | about 0.01 to about 0.10 |
| at least one nonionic lubricant having | about 0.05 to about 5.00 |

2. The dispersions of claim 1 wherein said nonionic lubricant is at least one member selected from the group consisting of polyalkylene glycol mono and di esters of fatty acids,
ethylene oxide adducts of fatty amides,
ethylene oxide adducts of fatty alcohols,
lower alkyl mono ethers of ethylene oxide-propylene oxide random or block copolymers,
sorbitan esters of fatty acids,
ethylene oxide and propylene oxide adducts of sorbitan esters of fatty acids,
lower alkyl mono ethers of polyethylene glycol mono esters of fatty acids, or
ethylene oxide-propylene oxide random or block copolymers.

3. The dispersions of claim 2 wherein said solids content is from about 55% by weight to about 75% by weight and said water content is from about 25% by weight to about 45% by weight.

4. The dispersions of claim 3 wherein said nonionic lubricant is at least one polyethylene glycol mono ester of a fatty acid.

5. The dispersions of claim 4 wherein said nonionic lubricant is polyethylene glycol 400 cocoate.

6. The dispersions of claim 4 wherein said nonionic lubricant is polyethylene glycol 400 monolaurate.

7. The dispersions of claim 4 wherein said nonionic lubricant is polyethylene glycol 600 monolaurate.

* * * * *